US009909387B2

(12) United States Patent
Scott et al.

(10) Patent No.: US 9,909,387 B2
(45) Date of Patent: Mar. 6, 2018

(54) SEMI-AUTONOMOUS INSERT VALVE FOR WELL SYSTEM

(71) Applicant: HALLIBURTON ENERGY SERVICES, INC., Houston, TX (US)

(72) Inventors: Bruce Edward Scott, McKinney, TX (US); Joseph Steven Grieco, McKinney, TX (US); James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 397 days.

(21) Appl. No.: 14/436,184

(22) PCT Filed: Oct. 26, 2012

(86) PCT No.: PCT/US2012/062086

§ 371 (c)(1),
(2) Date: Apr. 16, 2015

(87) PCT Pub. No.: WO2014/065813

PCT Pub. Date: May 1, 2014

(65) Prior Publication Data

US 2015/0275620 A1 Oct. 1, 2015

(51) Int. Cl.
*E21B 34/06* (2006.01)
*E21B 34/08* (2006.01)
(Continued)

(52) U.S. Cl.
CPC ..... *E21B 34/06* (2013.01); *E21B 23/02* (2013.01); *E21B 23/04* (2013.01); *E21B 34/066* (2013.01);
(Continued)

(58) Field of Classification Search
CPC ..... E21B 34/102; E21B 34/14; E21B 34/066; E21B 34/105
See application file for complete search history.

(56) References Cited

U.S. PATENT DOCUMENTS 4,191,248 A 3/1980 Huebsch et al.
4,768,594 A * 9/1988 Akkerman ..... E21B 34/06 166/319
(Continued)

FOREIGN PATENT DOCUMENTS

GB 2165285 A * 4/1986 ..... E21B 34/102
GB 2334540 A * 8/1999 ..... E21B 34/066

OTHER PUBLICATIONS

Magnetic Technologies Inc. , The DepthStar—A Solution to an Industry Dilemma, retrieved from the internet at http://www.halliburton.com/extranet/products/completions/depthstar_white_paperdoc, at least as early as 2004., 2014, 6 pages.
(Continued)

*Primary Examiner* — Jennifer H Gay
(74) *Attorney, Agent, or Firm* — Kilpatrick Townsend & Stockton LLP

(57) ABSTRACT

Certain aspects and embodiments of the present invention are directed to a semi-autonomous insert valve. The semi-autonomous insert valve includes a body, a closure mechanism coupled to the body, an autonomous actuation mechanism coupled to the body, and a control system disposed in the body. The body engages an inner wall of a subsurface safety valve and causes a subsurface safety valve closure mechanism to open, allowing fluid to flow toward the surface of the wellbore. The closure mechanism selectively allows fluid to flow toward the surface of the wellbore. The autonomous actuation mechanism actuates the closure mechanism independently from a subsurface safety valve actuation mechanism that actuates the subsurface safety
(Continued)

valve closure mechanism. The control sub-system includes one or more transceiving devices that can wirelessly communicate signals. The control sub-system closes the closure mechanism in response to losing signal communication between the transceiving devices and a signal source.

22 Claims, 7 Drawing Sheets

(51) Int. Cl.
*E21B 23/02* (2006.01)
*E21B 23/04* (2006.01)
*E21B 34/10* (2006.01)

(52) U.S. Cl.
CPC ..... *E21B 34/08* (2013.01); *E21B 34/105* (2013.01); *E21B 34/106* (2013.01)

(56) References Cited

U.S. PATENT DOCUMENTS 6,253,843 B1* 7/2001 Rawson ..... E21B 34/066 166/332.8
6,269,874 B1 8/2001 Rawson et al.
6,619,388 B2 9/2003 Dietz et al.
6,799,633 B2 10/2004 McGregor
7,987,913 B2* 8/2011 Parmeter ..... E21B 43/128 166/107
8,464,799 B2 6/2013 Scott et al.
8,490,687 B2 7/2013 Scott et al.
8,511,374 B2 8/2013 Scott et al.
2001/0013411 A1 8/2001 Beck et al.
2002/0108747 A1* 8/2002 Dietz ..... E21B 34/066 166/66.7
2003/0019622 A1* 1/2003 Goodson, Jr. ..... E21B 23/04 166/66.5
2003/0085815 A1* 5/2003 Tilton ..... E21B 34/066 340/854.4
2003/0234110 A1* 12/2003 McGregor ..... B23K 3/0623 166/373
2004/0065442 A1* 4/2004 Myerley ..... E21B 29/08 166/373
2006/0278395 A1 12/2006 Kenison et al.
2007/0187107 A1* 8/2007 Pringle ..... E21B 23/006 166/319
2009/0250206 A1 10/2009 Lake et al.
2010/0025045 A1* 2/2010 Lake ..... E21B 34/066 166/373
2011/0101675 A1* 5/2011 Smith, III ..... E21B 33/038 285/119
2011/0155381 A1* 6/2011 Reaux ..... E21B 34/066 166/334.1
2011/0155392 A1* 6/2011 Frazier ..... E21B 34/06 166/373
2011/0186303 A1* 8/2011 Scott ..... E21B 34/066 166/373
2013/0032355 A1* 2/2013 Scott ..... E21B 34/066 166/373
2013/0032356 A1* 2/2013 Scott ..... E21B 34/106 166/373
2013/0092389 A1* 4/2013 Du ..... E21B 17/01 166/367
2013/0175025 A1* 7/2013 Vick, Jr. ..... E21B 34/16 166/105
2013/0175042 A1* 7/2013 Scott ..... E21B 43/128 166/338
2013/0206389 A1* 8/2013 Vick, Jr. ..... E21B 34/101 166/105
2013/0220624 A1* 8/2013 Hill, Jr. ..... E21B 34/102 166/321
2013/0277064 A1* 10/2013 Xiao ..... E21B 43/128 166/372
2014/0083689 A1* 3/2014 Streich ..... E21B 34/063 166/250.15
2015/0123808 A1* 5/2015 Vick, Jr. ..... E21B 47/122 340/854.6
2015/0275620 A1* 10/2015 Scott ..... E21B 23/02 166/53
2015/0369005 A1* 12/2015 Vick, Jr. ..... E21B 34/14 166/319

OTHER PUBLICATIONS

International Patent Application No. PCT/US2012/062086 , International Search Report & Written Opinion, dated Apr. 29, 2013, 13 pages.

* cited by examiner

SEMI-AUTONOMOUS INSERT VALVE FOR WELL SYSTEM

CROSS-REFERENCE TO RELATED APPLICATIONS

This is a U.S. national phase under 35 U.S.C. § 371 of International Patent Application No. PCT/US2012/062086, titled "Semi-Autonomous Insert Valve for Well System" and filed Oct. 26, 2012, the entirety of which is hereby incorporated by reference herein.

TECHNICAL FIELD OF THE INVENTION

The present invention relates generally to devices for controlling fluid flow in a wellbore in a subterranean formation and, more particularly (although not necessarily exclusively), to a semi-autonomous insert valve for selectively restricting fluid flow from a well.

BACKGROUND

An oil or gas well for extracting fluids such as petroleum oil hydrocarbons from a subterranean formation can include one or more subsurface safety valves for restricting fluid flow from the well. A subsurface safety valve can include a selectively actuated closure mechanism, such as (but not limited to) a flapper valve. Selecting an open or closed position of the closure mechanism can prevent or otherwise restrict the flow of fluids from the subterranean formation toward the surface of the well.

The subsurface safety valve can sometimes cease to function. In one example, the subsurface safety valve can experience malfunctions causing the subsurface safety valve to enter a fail-safe configuration. In a fail-safe configuration, the closure mechanism of the subsurface safety valve can be set to a closed position, thereby preventing the flow of fluid from the well. In another example, a subsurface safety valve can require periodic maintenance. The closure mechanism can be set to a closed position while maintenance operations are performed.

When a subsurface safety valve is malfunctioning or otherwise inoperative, an insert valve having a second closure mechanism can be deployed in the wellbore. The insert valve can be positioned within the inner volume of the subsurface safety valve. Positioning the insert valve within the inner volume of the inoperative subsurface safety valve can set the closure mechanism of the subsurface safety valve to an open position. The closure mechanism of the insert valve can be selectively actuated to allow, prevent, or otherwise control the flow of fluid toward the surface of the well. The insert valve can thereby allow for continued production from the well when the subsurface safety valve is inoperative.

Prior solutions involve an inoperative subsurface safety valve and the insert valve using the same actuation mechanism to actuate their respective closure mechanisms. For example, the closure mechanism of an insert valve may be actuated by the same control line that is used to actuate the closure mechanism of the subsurface safety valve. If the control line malfunctions, neither the closure mechanism of the subsurface safety valve nor the closure mechanism of the insert valve can be actuated, thereby preventing the continue production of fluid from the wellbore.

Prior solutions may also involve using battery powered insert valves. Such solutions require pressurization above the insert valve in order to open the insert valve. Such solutions also use a poppet closure mechanism that can cause a large restriction in the flow path, which can be unsuitable for a safety valve applications involving long term production from a well.

It is desirable for an insert valve to include an actuation mechanism for actuating a closure mechanism the insert valve that can operate independently from an actuation mechanism for actuating a closure mechanism of a subsurface safety valve.

SUMMARY

Certain aspects and features of the present invention are directed to a semi-autonomous insert valve that can be disposed in a wellbore through a fluid-producing formation.

In one aspect, the semi-autonomous insert valve can include a body, a closure mechanism coupled to the body, an autonomous actuation mechanism coupled to the body, and a control sub-system disposed in the body. The body can engage an inner wall of a subsurface safety valve that is configured to close a subsurface safety valve closure mechanism in response to a malfunction. The body can cause the subsurface safety valve closure mechanism to open and allow fluid to flow toward the surface of the wellbore. The closure mechanism can selectively allow fluid to flow toward the surface of the wellbore. The autonomous actuation mechanism can actuate the closure mechanism independently from a subsurface safety valve actuation mechanism that actuates the subsurface safety valve closure mechanism. The control sub-system includes one or more transceiving devices that can wirelessly communicate signals. The control sub-system can cause the autonomous actuation mechanism to close the closure mechanism in response to a loss of signal communication between the one or more transceiving devices and a signal source.

In another aspect, a semi-autonomous insert valve can include a body, a closure mechanism coupled to the body, an autonomous actuation mechanism coupled to the body, a battery power subsystem, and a control sub-system disposed in the body. The body can engage an inner wall of a subsurface safety valve. The body can cause a subsurface safety valve closure mechanism to open and allow fluid to flow toward the surface of the wellbore. The closure mechanism can selectively allow fluid to flow toward the surface of the wellbore. The autonomous actuation mechanism can actuate the closure mechanism independently from a subsurface safety valve actuation mechanism that is configured for actuating the subsurface safety valve closure mechanism. The battery power subsystem can provide power to the autonomous actuation mechanism. The control sub-system includes one or more transceiving devices that can wirelessly communicate signals. The control sub-system can cause the autonomous actuation mechanism to close the closure mechanism in response to a loss of signal communication between the one or more transceiving devices and a signal source.

In another aspect, an assembly that can be disposed in a wellbore through a fluid-producing formation is provided. The assembly can include an electric subsurface safety valve and a semi-autonomous insert valve. The electric subsurface safety valve can be coupled to a cable and configured to receive electrical power via the cable. The electric subsurface safety valve can close a subsurface safety valve closure mechanism in response to a malfunction. The semi-autonomous insert valve can include a body, a closure mechanism coupled to the body, an autonomous actuation mechanism coupled to the body, at least one terminal, and a control sub-system disposed in the body. The body of the semi-autonomous insert valve can engage an inner wall of the electric subsurface safety valve. The body can cause a subsurface safety valve closure mechanism to open and allow fluid to flow toward the surface of the wellbore. The closure mechanism can selectively allow fluid to flow toward the surface of the wellbore. The autonomous actuation mechanism can actuate the closure mechanism independently from a subsurface safety valve actuation mechanism that is configured for actuating the subsurface safety valve closure mechanism. The terminal can be electrically coupled to the electric subsurface safety valve. The autonomous actuation mechanism can receive power via the terminal. The control sub-system includes one or more transceiving devices that can wirelessly communicate signals. The control sub-system can cause the autonomous actuation mechanism to close the closure mechanism in response to a loss of signal communication between the one or more transceiving devices and a signal source.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
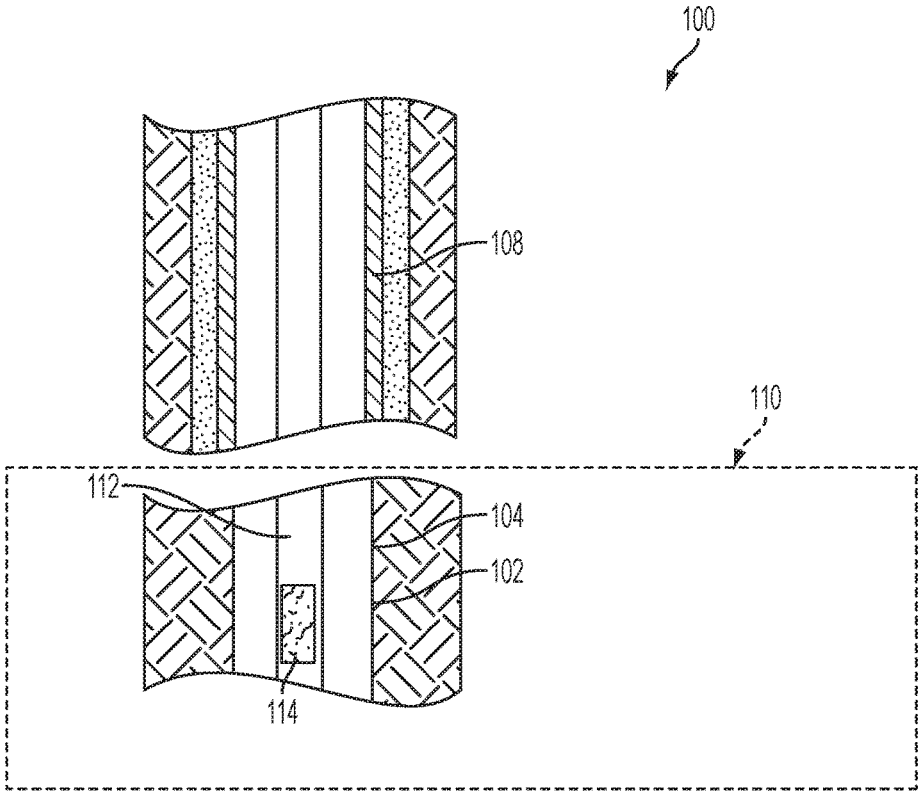
FIG. 1 is a schematic illustration of a well system having a subsurface safety valve that can be used with a semi-autonomous insert valve according to one aspect of the present invention.

Certain aspects and examples of the present invention are directed to a semi-autonomous insert valve that can be disposed in a wellbore through a fluid-producing formation. The semi-autonomous insert valve can be positioned within the inner volume of the subsurface safety valve such that a closure mechanism of the subsurface safety valve (e.g., a flapper valve) is set to an open position. For example, a subsurface safety valve coupled to a malfunctioning control line may be configured to close in response to the malfunction, thereby ceasing the production of fluid from the formation. The insert valve can be used to open the malfunctioning subsurface safety valve and selectively allow continued production of fluid from the formation. The semi-autonomous insert valve can include a closure mechanism that can be independently actuated without using the malfunctioning control line. The semi-autonomous insert valve can allow for continued production in a well system without relying on a control line or other actuation mechanism of the malfunctioning subsurface safety valve.

The semi-autonomous insert valve can include a body, a closure mechanism coupled to the body, an autonomous actuation mechanism coupled to the body, and a control sub-system disposed in the body. The body can be positioned within the inner volume of a subsurface safety valve. Positioning the body within the inner volume of the subsurface safety valve causes a closure mechanism of the subsurface safety valve to be in an open position, thereby allowing the flow of fluid toward the surface of the wellbore. The closure mechanism of the semi-autonomous insert valve can selectively allow the flow of fluid toward the surface of the wellbore. The autonomous actuation mechanism can actuate the closure mechanism of the semi-autonomous insert valve independently from an actuation mechanism for actuating a closure mechanism of the subsurface safety valve. A non-limiting example of an actuation mechanism of the subsurface safety valve is a control line coupled to the subsurface safety valve. The control sub-system includes one or more transceiving devices that can wirelessly communicate signals. The control sub-system can cause the autonomous actuation mechanism to close the closure mechanism in response to a loss of signal communication between the one or more transceiving devices and a signal source. For example, the control sub-system can detect the loss of communication with a control unit at the surface or another downhole tool. The control sub-system can configure the autonomous actuation mechanism to set the closure mechanism to a closed position.

The semi-autonomous insert valve can also include a power supply mechanism for providing power to the autonomous actuation mechanism. The power supply mechanism can include any device, tool, or group of devices or tools for generating electrical power to be provided to the autonomous actuation mechanism and/or coupling the autonomous actuation mechanism to a source of electrical power.

In some aspects, the power supply mechanism can be a battery power subsystem coupled to the body of the semi-autonomous insert valve. The battery power subsystem can be selectively coupled to the body such that the battery power subsystem is retrievable separately from the semi-autonomous insert valve. Retrieving the battery power subsystem separately from the semi-autonomous insert valve can allow the battery power subsystem to be replaced while the closure mechanism of the semi-autonomous insert valve prevents the flow of fluid, thereby extending the operational lifespan of the semi-autonomous insert valve.

In other aspects, the power supply mechanism can include at least one terminal that can be electrically coupled to an additional tool in the wellbore. The autonomous actuation mechanism can receive power via an electrical connection formed by the at least one terminal. In some aspects, the additional tool can be the subsurface safety valve, such as an electric subsurface safety valve. The terminal of the semi-autonomous insert valve can be electrically coupled to a terminal of the electric subsurface safety valve. The semi-autonomous insert valve can receive power from the electric subsurface safety valve via the electrical connection. In other aspects, the additional tool in the wellbore can be a tool separate from the subsurface safety valve, such as (but not limited to) a docking station. The terminal of the semi-autonomous insert valve can be electrically coupled to a terminal of the docking station to receive power for the autonomous actuation mechanism.

In some aspects, the autonomous actuation mechanism includes a piston and a pump. The piston can apply a force for causing the closure mechanism of the semi-autonomous insert valve to be in an open position, thereby allowing the flow of fluid toward the surface of the wellbore. The piston can be actuated by the pump. The pump can actuate the piston by communicating pressure from a pressure source to the piston. The pump can be an electro-mechanical pump configured to receive power from the power supply mechanism. The autonomous actuation mechanism can also include a release mechanism, such as a dump valve, that is configured to release pressure applied to the piston, thereby causing the closure mechanism of the semi-autonomous insert valve to be in a closed position. The release mechanism can receive power from the power supply mechanism.

In additional or alternative aspects, the control sub-system can include a processing module. The processing module can control the autonomous actuation mechanism in response to signals from the control system. In some aspects, the control sub-system can wirelessly communicate directly with control system at the surface. In other aspects, the control sub-system can wirelessly communicate directly with an additional tool in the wellbore that is in communication with the control system at the surface, such as (but not limited to) a docking system communicating with the control system via a cable. The additional tool can relay signals between the control system and the control sub-system of the semi-autonomous insert valve.

In some aspects, the pressure source for the autonomous actuation mechanism can be a fluid reservoir coupled to the body of the semi-autonomous insert valve. The fluid reservoir can be selectively coupled to the body such that the fluid reservoir is retrievable separately from the semi-autonomous insert valve.

In other aspects, the pressure source for the autonomous actuation mechanism can be a dielectric fluid reservoir of the subsurface safety valve. For example, an electric subsurface safety valve can include a reservoir of dielectric fluid for protecting components of the electric subsurface safety valve from contamination from water or other downhole fluids. The dielectric fluid reservoir can include or be enclosed by a barrier, such as a seal or a slidable barrier. The semi-autonomous insert valve can include an additional actuation mechanism configured to rupture a seal or move a slidable barrier, thereby allowing the semi-autonomous insert valve to access the dielectric fluid reservoir of the electric subsurface safety valve.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples. The following sections use directional descriptions such as "above," "below," "upper," "lower," "upward," "downward," "left," "right," "uphole," "downhole," etc. in relation to the illustrative examples as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative examples, the numerals and directional descriptions included in the following sections should not be used to limit the present invention.

FIG. 1 schematically depicts a well system 100 with a subsurface safety valve that can be used with a semi-autonomous insert valve. The well system 100 includes a wellbore 102 extending through various earth strata. The wellbore 102 has a substantially vertical section 104. The substantially vertical section 104 may include a casing string 108 cemented at an upper portion of the substantially vertical section 104. The substantially vertical section 104 extends through a hydrocarbon-bearing subterranean formation 110.

A tubing string 112 extends from the surface within wellbore 102. The tubing string 112 can define a passageway providing a conduit for production of formation fluids to the surface.

The subsurface safety valve 114 is positioned within a passageway defined by the tubing string 112. The subsurface safety valve 114 is depicted as functional block in FIG. 1. Pressure from the subterranean formation 110 can cause fluids to flow from the subterranean formation 110 to the surface. The subsurface safety valve 114 can include equipment capable of restricting or preventing the production of formation fluids.

Although FIG. 1 depicts the subsurface safety valve positioned in the substantially vertical section 104, a subsurface safety valve can be located, additionally or alternatively, in a deviated section, such as a substantially horizontal section. In some aspects, subsurface safety valves 114 can be disposed in wellbores having both a substantially vertical section and a substantially horizontal section. Subsurface safety valves 114 can be disposed in open hole environments, such as is depicted in FIG. 1, or in cased wells.

Figure 2:
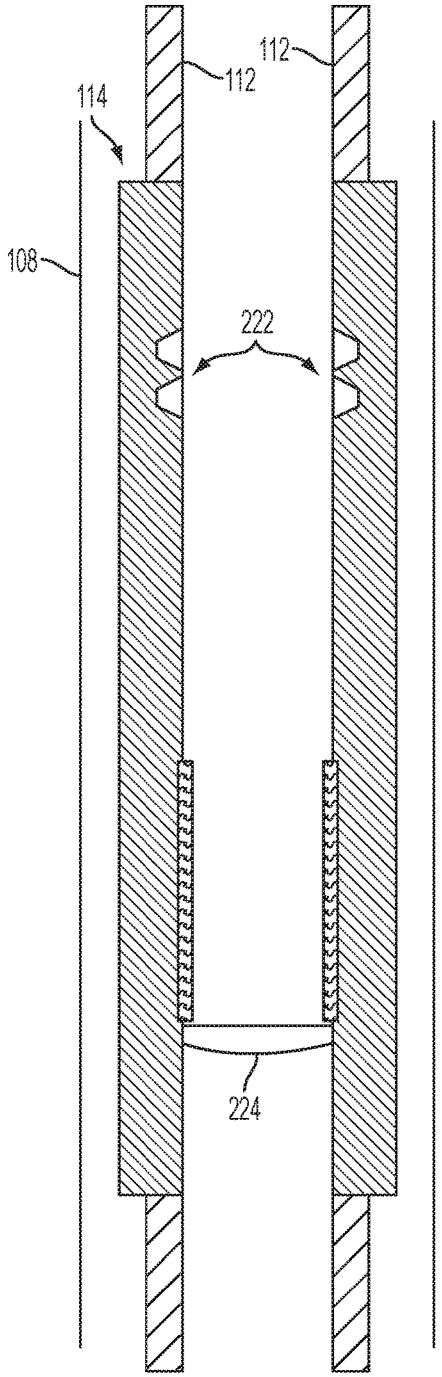
FIG. 2 is a cross-sectional side view of a subsurface safety valve in which a semi-autonomous insert valve can be positioned according to one aspect of the present invention.
Figure 3:
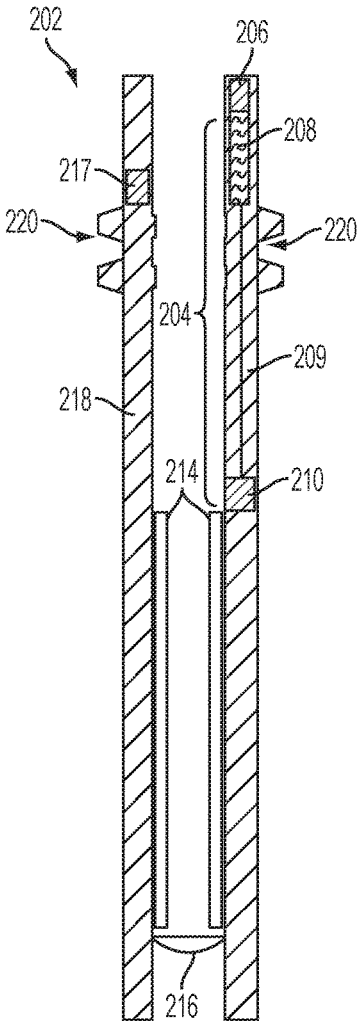
FIG. 3 is a cross-sectional side view of a semi-autonomous insert valve powered by a battery power subsystem according to one aspect of the present invention.

FIGS. 2-3 respectively depict a cross-sectional side view of a subsurface safety valve 114 and a semi-autonomous insert valve 202 having an autonomous actuation mechanism 204 powered by a battery power sub-system 206.

The subsurface safety valve 114 can include a landing profile 222 and a closure mechanism 224.

The landing profile 222 can include a surface configured to interlock with another downhole tool (e.g., the semi-autonomous insert valve 202) such that the downhole tool is oriented (or "docked") in the inner volume of the subsurface safety valve 114. The landing profile 222 can be coupled to or integral with the body of the subsurface safety valve 114. Although FIG. 2 depicts a subsurface safety valve 114 using a landing profile 222 to orient a tool, any suitable mechanism can be used for orienting a tool within the inner volume of the subsurface safety valve 114. Non-limiting examples of other orientation mechanisms include a nipple profile or a key mechanism.

The closure mechanism 224 can be any suitable mechanism for preventing or otherwise restricting the flow of fluid toward the surface of the wellbore 102. One example of a closure mechanism 224 is a flapper valve, as depicted in FIG. 2. A flapper valve can include a spring-loaded plate allowing fluids to be pumped in the downhole direction from the surface toward the fluid-producing formation. The flapper valve can close when the flow of fluid is directed toward the surface. Other examples of closure mechanisms include (but are not limited to) a ball valve or a poppet valve. A ball valve can include a spherical disc having a port through the middle such that fluids can flow through the ball valve when the port is aligned with both ends of the ball valve. The ball valve can be closed to block the flow of fluids by orienting spherical disc such that the port is perpendicular to the ends of the ball valve. A poppet valve can include a hole and a tapered plug portion, such as a disk shape on the end of a shaft. The shaft guides the plug portion by sliding through a valve guide. A pressure differential can seal the poppet valve.

The subsurface safety valve 114 can be deployed into the casing string 108 via any suitable mechanism. For example, as depicted in FIG. 2, the subsurface safety valve 114 is a tubing-deployed subsurface safety valve that is positioned in the casing string 108 using a section of the tubing string 112. A tubing-deployed subsurface safety valve 114 can be immovable once deployed. In other aspects, the subsurface safety valve 114 can be deployed via a wireline unit coupled to the subsurface safety valve 114.

The semi-autonomous insert valve 202 can include an autonomous actuation mechanism 204 powered by the battery power sub-system 206. The autonomous actuation mechanism 204 can include a fluid reservoir 208 from which pressure can be communicated to a piston 210 via a chamber 209, as described in detail below with respect to FIG. 8. Communicating pressure to the piston 210 can cause the piston 210 to apply force to a sleeve 214 of the semi-autonomous insert valve 202. Applying force to a sleeve 214 can cause the sleeve 214 to apply force to the closure mechanism 216 of the of the semi-autonomous insert valve 202, thereby setting the closure mechanism 216 to an open position. Ceasing to apply force to the sleeve 214 can cease the application of force to the closure mechanism 216, thereby setting the closure mechanism 216 to a closed position.

The semi-autonomous insert valve 202 can also include a control sub-system 217. The control sub-system 217 can include any suitable device or group of devices for communicating signals between the subsurface safety valve and another system. For example, control sub-system 217 can include one or more transceiving devices. A transceiving device can include a transmitter and a receiver for wirelessly transmitting signals and wireless receiving signals.

The control sub-system 217 can be configured to communicate via a wireless connection to a control system or other downhole tool. In one example, a control system can be located at a rig at the surface. An operator can control the operation of the semi-autonomous insert valve 202 using control signals communicated from the control system to the semi-autonomous insert valve 202 via the control sub-system 217. In another example, a control system located can communicate control signals to an additional communication sub-system of an additional tool in the wellbore 102, such as (but not limited to) the subsurface safety valve 114 or a docking station. The additional communication sub-system of the additional tool can communicate the control signals to the semi-autonomous insert valve 202.

The control sub-system 217 can also include a processing device. The processing device can process signals received by the one or more transceiving devices, such as command or control signals transmitted by a rig at the surface of the wellbore. The processing device can control the operation of the autonomous actuation mechanism 204 in response to the signals received by the one or more transceiving devices. The processing device can include any suitable control circuitry for controlling one or more functions of the autonomous actuation mechanism 204. Examples of the processing device include a microprocessor, a peripheral interface controller ("PIC"), an application-specific integrated circuit ("ASIC"), a field-programmable gate array ("FPGA"), or other suitable processing device. The processing device may include one processor or any number of processors.

The control sub-system 217 can also include one or more chambers integral in which the transceiving device(s) and processing device(s) can be disposed. The chamber(s) can store non-conducting fluid, such as a silicone oil fluid or another silicone fluid or dielectric fluid. The non-conducting fluid can prevent the transceiving device(s) and processing device(s) from being contaminated by water or other downhole fluids in the wellbore 102.

The control sub-system 217 of the semi-autonomous insert valve 202 can provide a fail-safe feature. The fail-safe feature can cause the semi-autonomous insert valve 202 to close in response to a loss of communication between the transceiving device(s) and a signal source, such as (but not limited to) a control unit at the surface or another downhole tool.

For example, the processing device(s) can detect that no signals are being received by the transceiving device(s). The processing device(s) can configure the battery power sub-system 206 to cease providing power to the autonomous actuation mechanism 204 and/or disconnect the autonomous actuation mechanism 204 from the battery power sub-system 206 or another power source in response to detecting that no signals are being received. A fail-safe mechanism for the autonomous actuation mechanism 204 can cause the sleeve 214 to retract or otherwise cause the closure mechanism 216 to close in response to a cessation of power being provided to the autonomous actuation mechanism 204. Additionally or alternatively, the processing device(s) can configure the autonomous actuation mechanism 204 to retract the sleeve 214 in response to detecting that no signals are being received, thereby closing the closure mechanism 216.

The semi-autonomous insert valve 202 can also include a landing profile 220 that is integral with or coupled to a body 218 of the semi-autonomous insert valve 202. The landing profile 220 can be configured to interlock with the landing profile 222.

The semi-autonomous insert valve 202 can be retrieved from the wellbore 102 via any suitable mechanism, such as (but not limited to) a wireline unit. In some aspects, one or more components of the semi-autonomous insert valve 202 can be separately retrieved from the wellbore 102. In one example, the battery power sub-system 206 can be selectively coupled to the body 218. The battery power sub-system 206 can be de-coupled from the body 218 and retrieved from the wellbore 102 separately from the semi-autonomous insert valve 202. In another example, the fluid reservoir 208 can be selectively coupled to the body 218. The fluid reservoir 208 can be de-coupled from the body 218 and retrieved from the wellbore 102 separately from the semi-autonomous insert valve 202. In other aspects, the semi-autonomous insert valve 202 can be retrieved a single unit.

Figure 4:
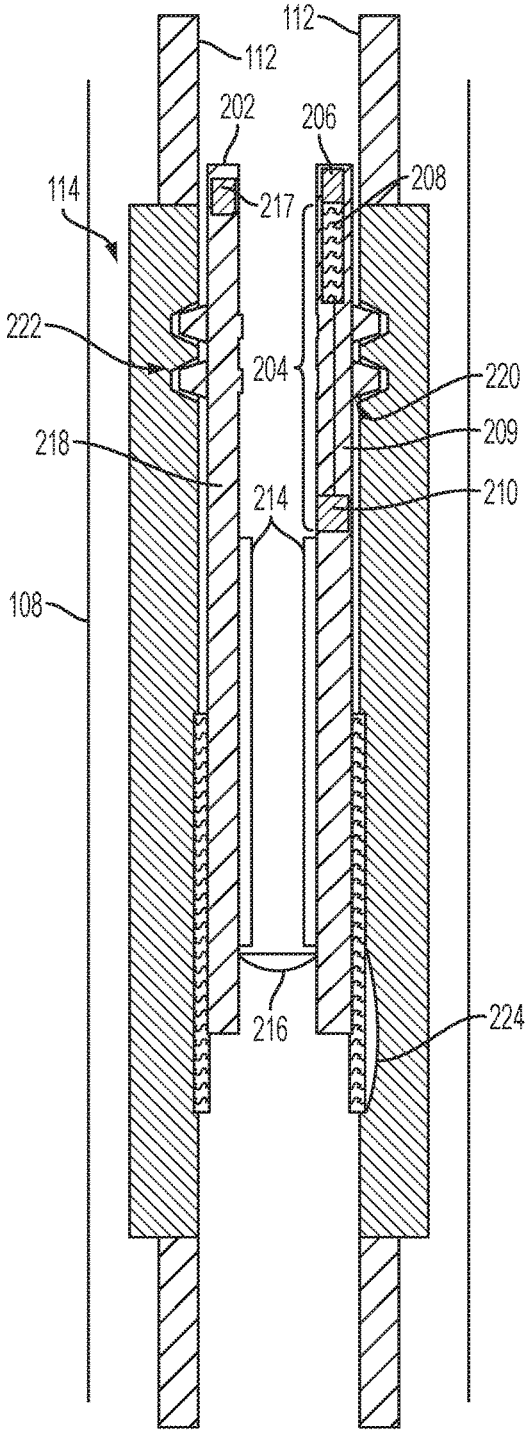
FIG. 4 is a cross-sectional side view of the semi-autonomous insert valve powered by a battery power subsystem positioned within the subsurface safety valve according to one aspect of the present invention.

FIG. 4 depicts a cross-sectional side view of the semi-autonomous insert valve 202 positioned within the subsurface safety valve 114. The semi-autonomous insert valve 202 can be deployed into the tubing string 112 via any suitable mechanism, such as (but not limited to) a wireline unit. The landing profile 220 can interlock with the landing profile 222, thereby "docking" the semi-autonomous insert valve 202 within the inner volume of the subsurface safety valve 114. Positioning the semi-autonomous insert valve 202 within the inner volume of the subsurface safety valve 114 can apply a force to the closure mechanism 224, thereby setting the closure mechanism 224 to an open position. The closure mechanism 224 being in an open position can prevent the subsurface safety valve 114 from restricting the flow of fluid toward the surface of the wellbore 102. The semi-autonomous insert valve 202 can be configured to control the flow of fluid toward the surface of the wellbore 102.

Figure 5:
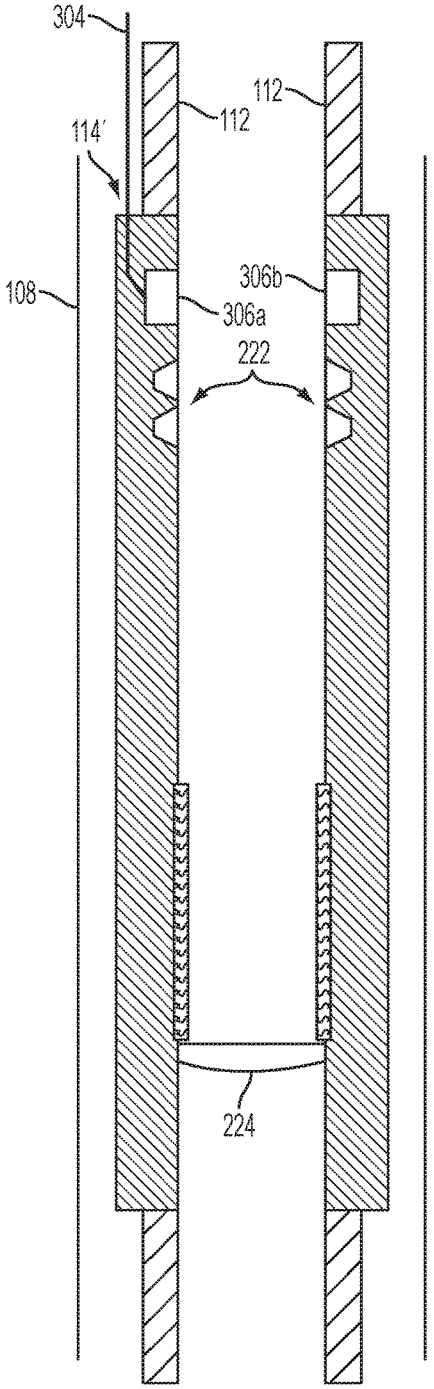
FIG. 5 is a cross-sectional side view of an electric subsurface safety valve in which a semi-autonomous insert valve can be positioned according to one aspect of the present invention.

In additional or alternative aspects, a semi-autonomous insert valve can be configured to receive power from another tool in the wellbore 102. For example, FIGS. 5-6 respectively depict a cross-sectional side view of an electric subsurface safety valve 114' and a semi-autonomous insert valve 202' having an autonomous actuation mechanism 204 powered via an electrical connection with a downhole tool. A downhole tool providing power to the semi-autonomous insert valve 202' can be the electric subsurface safety valve 114' or another downhole tool.

The electric subsurface safety valve 114' can be coupled to an electrical control line 304. The electrical control line 304 can connect the electric subsurface safety valve 114' to a power source in the wellbore 102 or to a control unit at the surface of the wellbore 102. The electric subsurface safety valve 114' can receive electrical power via the electrical control line 304.

The electric subsurface safety valve 114' can include terminals 306*a*, 306*b*. The electric subsurface safety valve 114' can form an electrical connection with corresponding terminals from another downhole tool, such as the terminals 302*a*, 302*b* of the semi-autonomous insert valve 202'. In some aspects, an electrical connection can be formed via direct contact between the terminals 302*a*, 302*b* and the terminals 306*a*, 306*b*. In other aspects, an electrical connection can be formed by inductively coupling the terminals 302*a*, 302*b* and the terminals 306*a*, 306*b*.

Figure 7:
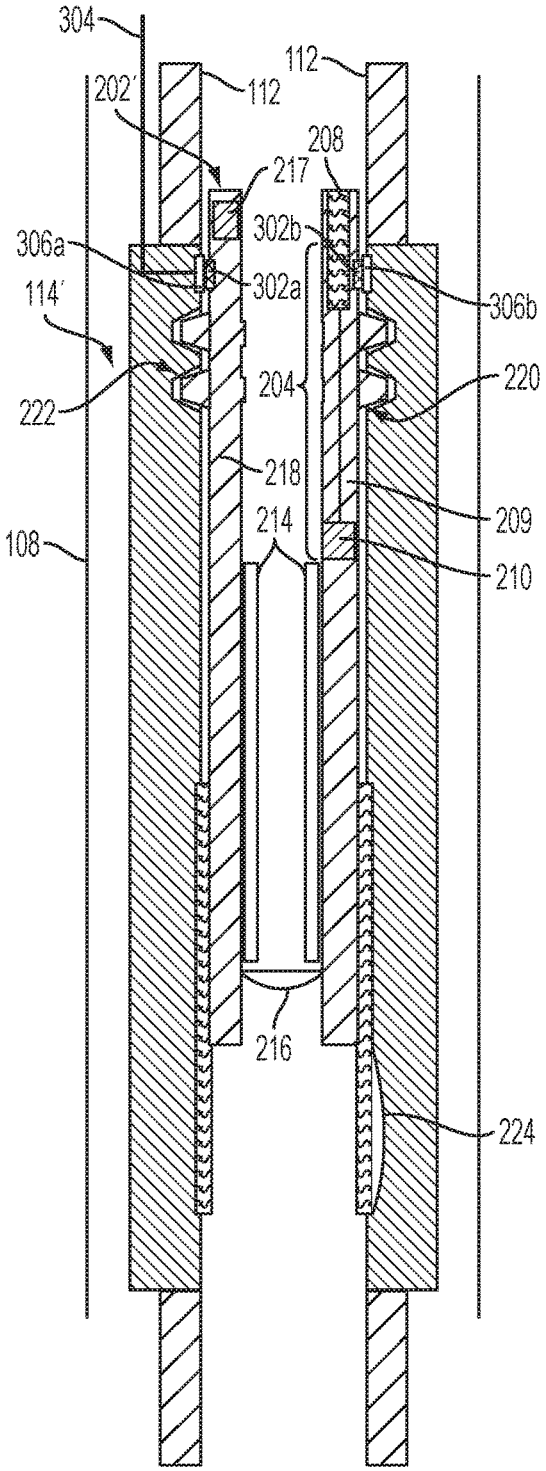
FIG. 7 is a cross-sectional side view of the semi-autonomous insert valve powered by an electrical connection with a downhole tool positioned within the subsurface safety valve according to one aspect of the present invention.

FIG. 7 depicts a cross-sectional side view of the semi-autonomous insert valve 202' positioned within the electric subsurface safety valve 114'. The landing profile 220 can interlock with the landing profile 222 such that the terminals 302*a*, 302*b* are oriented with respect to the terminals 306*a*, 306*b*, thereby forming an electrical connection between the terminals 302*a*, 302*b* and the terminals 306*a*, 306*b*.

Figure 6:
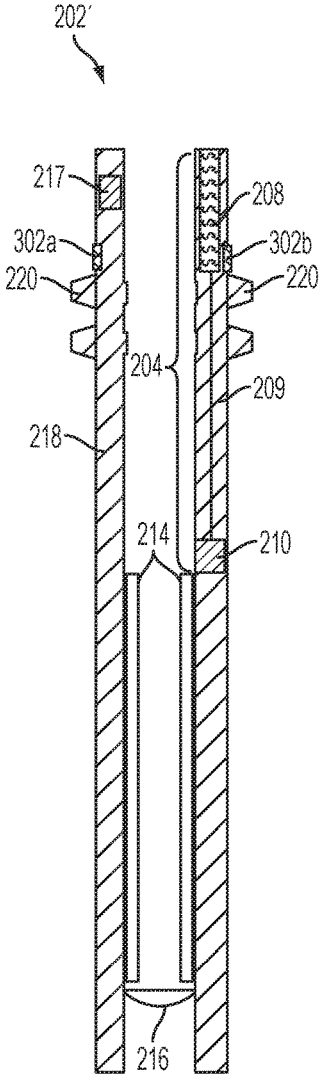
FIG. 6 is a cross-sectional side view of a semi-autonomous insert valve powered by an electrical connection with a downhole tool according to one aspect of the present invention.

Although FIGS. 6-7 omit the battery power sub-system 206, other implementations are possible. For example, a semi-autonomous insert valve 202 can include both a battery power sub-system 206 and the terminals 302*a*, 302*b*. The semi-autonomous insert valve 202 can receive power via the terminals 302*a*, 302*b*. The power received via the terminals 302*a*, 302*b* can be used to charge a battery power sub-system 206. The battery power sub-system 206 can provide power for operating the autonomous actuation mechanism 204.

Figure 8:
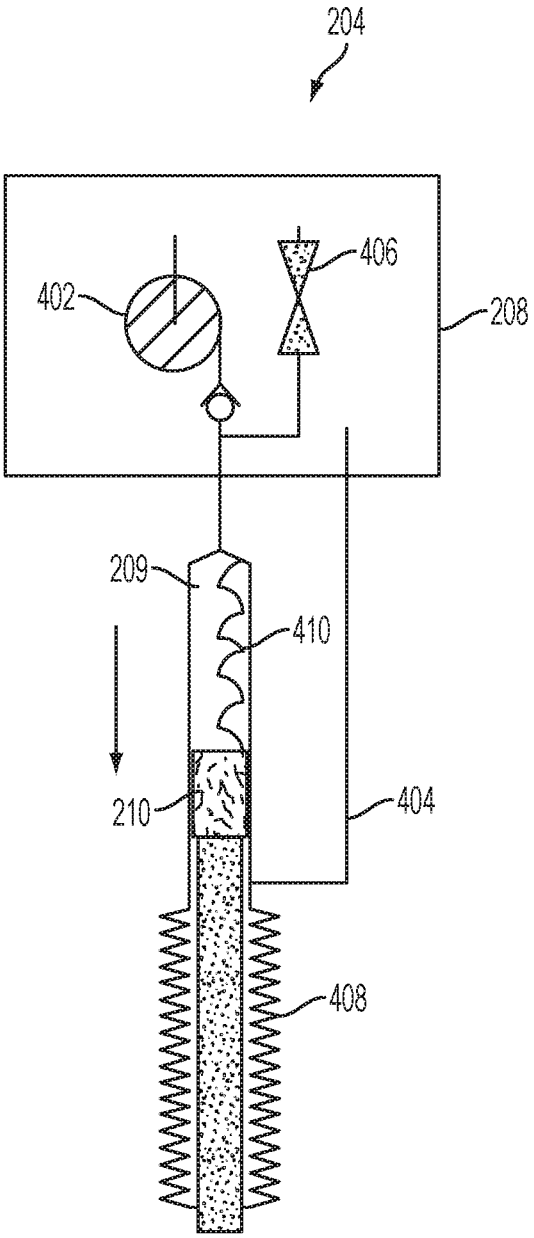
FIG. 8 is a diagram of an example autonomous actuation mechanism of a semi-autonomous insert valve according to one aspect of the present invention.

FIG. 8 depicts an example autonomous actuation mechanism 204. The autonomous actuation mechanism 204 can include the fluid reservoir 208, a pump 402, a dump valve 406, the chamber 209, the piston 210, and a fluid line 404. The pump 402 and the dump valve 406 can be disposed in the fluid reservoir 208.

A processing device of the semi-autonomous insert valve 202 can configure the pump 402. An example of the pump 402 is an electro-mechanical pump. The pump 402 can receive power from a power supply mechanism, such as the battery power sub-system or one or more terminals 302*a*, 302*b*. The pump 402 can communicate pressure to the piston 210 by pumping fluid from the fluid reservoir into the chamber 209. Communicating pressure to the piston 210 can cause the piston 210 to move away from the fluid reservoir 208, as depicted by the downward arrow in FIG. 8. The piston 210 can apply force to the sleeve 214, thereby causing the closure mechanism 216 to open.

Fluid from the chamber 209 that is forced past the edge of the piston 210 can be collected in the bellows portion 408 of the chamber 209. Fluid collected in the collected in the bellows portion 408 of the chamber 209 can be returned to the fluid reservoir 208 via the fluid line 404, thereby providing a closed system for the autonomous actuation mechanism 204.

Figure 9:
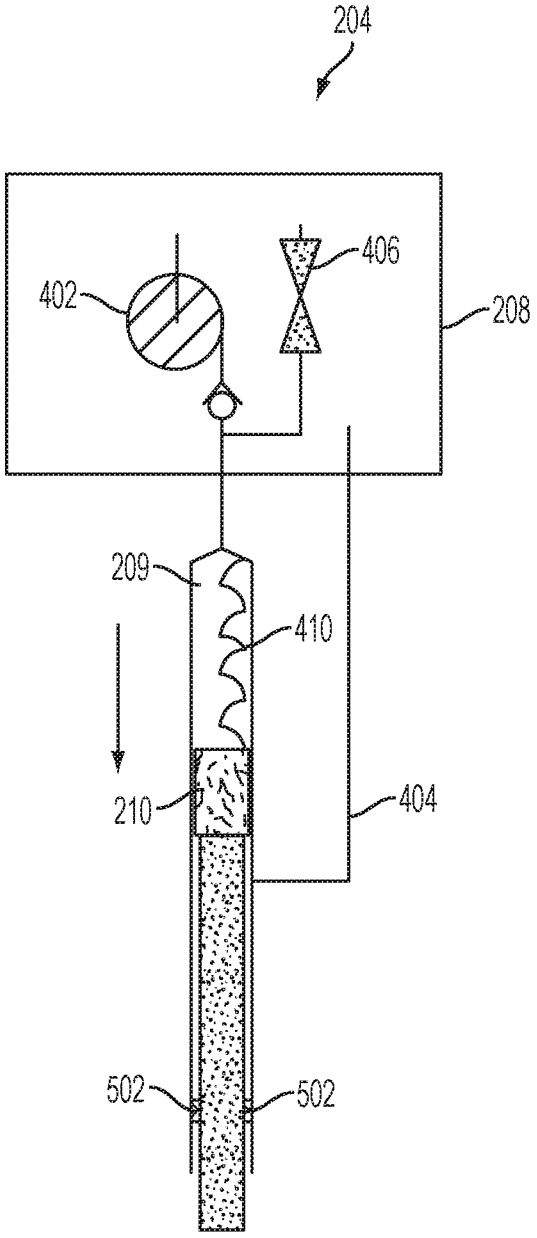
FIG. 9 is a diagram of an example autonomous actuation mechanism of a semi-autonomous insert valve according to one aspect of the present invention.

Although FIG. 8 depicts a bellows portion 408 for collecting fluid that is forced past the edge of the piston 210, other implementations are possible. For example, as depicted in FIG. 9, a seal 502 can be disposed in the chamber 209. The seal 502 can prevent fluid from flowing past the edge of the piston 210. In additional or alternative aspects, any suitable mechanism for collecting fluid that is forced past the edge of the piston 210 or for preventing prevent fluid from flowing past the edge of the piston 210 can be used.

The closure mechanism 216 of the semi-autonomous insert valve 202 can be set to a closed position using the dump valve 406 and a retention mechanism 410. The piston 210 can be coupled to a retention mechanism 410, such as (but not limited to) an expansion spring. A retention mechanism 410 such as an expansion spring can expand in response to pressure being communicated to the piston 210. The dump valve 406 can be actuated to cause fluid pumped into the chamber 209 to be returned to the fluid reservoir 208, thereby ceasing the communication of pressure to the piston 210. The expansion spring can contract in response to the cessation of pressure being communicated to the piston 210. Contracting the expansion spring can cease the application of force by the piston 210 to the sleeve 214, thereby closing the closure mechanism 216.

In some aspects, the dump valve 406 can be actuated by ceasing to provide power to the pump 402. A solenoid can prevent the actuation of the dump valve 406 while power is provided to the pump 402. Ceasing to provide power to the pump 402 can allow the actuation of the dump valve 406.

Although FIGS. 2-6 depict a fluid reservoir 208 that is the pressure source for the piston 210, other implementations are possible. In additional or alternative aspects, the pressure source for the autonomous actuation mechanism 204 can be a dielectric fluid reservoir of an electric subsurface safety valve 114'. The electric subsurface safety valve 114' can include a reservoir of dielectric fluid for protecting components of the electric subsurface safety valve 114' from contamination from water or other downhole fluids in the wellbore 102. The dielectric fluid reservoir can include or be enclosed by a barrier, such as a seal or a slidable barrier. The semi-autonomous insert valve can include an additional actuation mechanism configured to rupture a seal or move a slidable barrier, thereby allowing the semi-autonomous insert valve to access the dielectric fluid reservoir of the electric subsurface safety valve.

The foregoing description of the invention, including illustrated examples and aspects, has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A semi-autonomous insert valve configured for being disposed in a wellbore through a fluid-producing formation, the semi-autonomous insert valve comprising:

a body adapted for engaging an inner wall of a subsurface safety valve and for causing a subsurface safety valve closure mechanism to open and allow fluid to flow toward the surface of the wellbore;

a closure mechanism coupled to the body, the closure mechanism being configured to selectively allow fluid to flow toward the surface of the wellbore;

an autonomous actuation mechanism coupled to the body, the autonomous actuation mechanism including a pressure source selectively coupled to the body such that the pressure source is retrievable separately from the semi-autonomous insert valve, the autonomous actuation mechanism also being configured to actuate the closure mechanism independently from a subsurface safety valve actuation mechanism that is configured for actuating the subsurface safety valve closure mechanism; and a control sub-system disposed in the body and comprising one or more transceiving devices configured to wirelessly communicate signals, the control sub-system configured to cause the autonomous actuation mechanism to close the closure mechanism in response to a loss of signal communication between the one or more transceiving devices and a signal source.

2. The semi-autonomous insert valve of claim 1, further comprising a power supply mechanism configured to provide power to the autonomous actuation mechanism.

3. The semi-autonomous insert valve of claim 2, wherein the autonomous actuation mechanism comprises:

a piston configured to apply a force causing the closure mechanism to be in an open position allowing the flow of fluid toward the surface of the wellbore; and a pump configured to communicate pressure from the pressure source to the piston, wherein the pump is configured to receive power from the power supply mechanism.

4. The semi-autonomous insert valve of claim 3, wherein the pressure source comprises a fluid reservoir of the autonomous actuation mechanism.

5. The semi-autonomous insert valve of claim 3, wherein the pressure source comprises a dielectric fluid reservoir of the subsurface safety valve.

6. The semi-autonomous insert valve of claim 5, further comprising a reservoir access mechanism configured to puncture a seal enclosing the dielectric fluid reservoir.

7. The semi-autonomous insert valve of claim 5, further comprising a reservoir access mechanism configured to open a sliding barrier enclosing the dielectric fluid reservoir.

8. The semi-autonomous insert valve of claim 2, wherein the power supply mechanism comprises a battery power subsystem coupled to the body.

9. The semi-autonomous insert valve of claim 8, wherein the battery power subsystem is selectively coupled to the body such that the battery power subsystem is retrievable separately from the semi-autonomous insert valve.

10. The semi-autonomous insert valve of claim 2, wherein the power supply mechanism comprises at least one terminal adapted to be electrically coupled to an electric subsurface safety valve in the wellbore, wherein the autonomous actuation mechanism is configured for receiving power via the at least one terminal.

11. The semi-autonomous insert valve of claim 2, wherein the body is further configured to be coupled to a docking station, wherein the power supply mechanism comprises at least one terminal configured to be electrically coupled with the docking station, wherein the autonomous actuation mechanism is configured for receiving power via the at least one terminal.

12. The semi-autonomous insert valve of claim 1, wherein the control sub-system further comprises a processing module configured to control the autonomous actuation mechanism in response to the signals.

13. A semi-autonomous insert valve configured for being disposed in a wellbore through a fluid-producing formation, the semi-autonomous insert valve comprising:

a body adapted for engaging an inner wall of a subsurface safety valve and for causing a subsurface safety valve closure mechanism to open and allow fluid to flow toward the surface of the wellbore;

a closure mechanism coupled to the body, the closure mechanism being configured to selectively allow fluid to flow toward the surface of the wellbore;

an autonomous actuation mechanism coupled to the body, the autonomous actuation mechanism being configured to actuate the closure mechanism independently from a subsurface safety valve actuation mechanism that is configured for actuating the subsurface safety valve closure mechanism;

a battery power subsystem configured to provide power to the autonomous actuation mechanism, the battery power subsystem being selectively coupled to the body such that the battery power subsystem is retrievable separately from the semi-autonomous insert valve; and a control sub-system disposed in the body and comprising one or more transceiving devices configured to wirelessly communicate signals, the control sub-system configured to cause the autonomous actuation mechanism to close the closure mechanism in response to a loss of signal communication between the one or more transceiving devices and a signal source.

14. The semi-autonomous insert valve of claim 13, wherein the autonomous actuation mechanism comprises:

a piston configured to apply a force causing the closure mechanism to be in an open position allowing the flow of fluid toward the surface of the wellbore; and a pump configured to communicate pressure from a pressure source to the piston, wherein the pump is configured to receive power via the battery power subsystem.

15. The semi-autonomous insert valve of claim 14, wherein the pressure source comprises a fluid reservoir of the autonomous actuation mechanism.

16. The semi-autonomous insert valve of claim 15, wherein the fluid reservoir is selectively coupled to the body such that the fluid reservoir is retrievable separately from the semi-autonomous insert valve.

17. The semi-autonomous insert valve of claim 13, wherein the control sub-system further comprises a processing module configured to control the autonomous actuation mechanism in response to the signals.

18. An assembly configured for being disposed in a wellbore through a fluid-producing formation, the assembly comprising:

an electric subsurface safety valve coupled to a cable and configured to receive electrical power via the cable; and a semi-autonomous insert valve, the semi-autonomous insert valve comprising:

a body adapted for engaging an inner wall of the electric subsurface safety valve and for causing the subsurface safety valve closure mechanism to open and allow fluid to flow toward the surface of the wellbore, a closure mechanism coupled to the body, the closure mechanism being configured to selectively allow fluid to flow toward the surface of the wellbore, an autonomous actuation mechanism coupled to the body, the autonomous actuation mechanism including a pressure source selectively coupled to the body such that the pressure source is retrievable separately from the semi-autonomous insert valve, the autonomous actuation mechanism also being configured to actuate the closure mechanism independently from a subsurface safety valve actuation mechanism that is configured for actuating the subsurface safety valve closure mechanism, at least one terminal adapted to be electrically coupled to the electric subsurface safety valve, wherein the autonomous actuation mechanism is configured for receiving power via the at least one terminal, and a control sub-system disposed in the body and comprising one or more transceiving devices configured to wirelessly communicate signals, the control sub-system configured to cause the autonomous actuation mechanism to close the closure mechanism in response to a loss of signal communication between the one or more transceiving devices and a signal source.

19. The assembly of claim 18, wherein the autonomous actuation mechanism comprises:

a piston configured to apply a force causing the closure mechanism to be in an open position allowing the flow of fluid toward the surface of the wellbore; and a pump configured to communicate pressure from the pressure source to the piston, wherein the pump is configured to receive power via the at least one terminal.

20. The semi-autonomous insert valve of claim 19, wherein the pressure source comprises a fluid reservoir of the autonomous actuation mechanism.

21. The assembly of claim 18, wherein the control subsystem further comprises a processing module configured to control the autonomous actuation mechanism in response to the signals.

22. The assembly of claim 18, wherein the semi-autonomous insert valve further comprises a battery power subsystem configured to receive the power via the at least one terminal and provide the power to the autonomous actuation mechanism.

* * * * *